United States Patent [19]

Takahashi

[11] 4,294,170

[45] Oct. 13, 1981

[54] ROLL FEED DEVICE FOR FEEDING MATERIAL TO A PRESS

[75] Inventor: Yuu Takahashi, Hachioji, Japan

[73] Assignee: Aida Engineering, Ltd., Sagamihara, Japan

[21] Appl. No.: 116,602

[22] Filed: Jan. 24, 1980

[30] Foreign Application Priority Data

Feb. 1, 1979 [JP] Japan ..... 54-10778[U]

[51] Int. Cl.[3] ..... B30B 15/30

[52] U.S. Cl. ..... 100/216; 226/141; 83/436

[58] Field of Search ..... 100/215, 216; 83/244, 83/528, 228, 436, 273; 226/137, 138, 139, 141, 142, 156, 152, 157; 74/206, 207, 325, 199, 202, 208, 210

[56] References Cited

U.S. PATENT DOCUMENTS

| | | | |
|---|---|---|---|
| 3,731,620 | 5/1973 | Klemmer | 100/170 |
| 3,754,705 | 8/1973 | Wiig | 226/156 |
| 4,024,774 | 5/1977 | Johnson | 100/215 |

*Primary Examiner*—Billy J. Wilhite

*Attorney, Agent, or Firm*—Wenderoth, Lind & Ponack

[57] ABSTRACT

A roll feed device for feeding a material to a press in a predetermined timed relationship to the operation of the press. The device includes a pair of feed rolls between which the material is fed, one being an idle roll and the other being a driven roll. The driven roll has a drive shaft, and an intermittent rotating mechanism is operably associated with the drive shaft of the press and has an output shaft parallel to the drive shaft of the driven roll. Disks are mounted on the ends of these shafts and are in frictional engagement with each other for driving the drive shaft from the output shaft. The disks can be easily exchanged for changing the drive of the roll feed device.

2 Claims, 3 Drawing Figures

ROLL FEED DEVICE FOR FEEDING MATERIAL TO A PRESS

BACKGROUND OF THE INVENTION AND PRIOR ART

The present invention relates to a roll feed device for automatically supplying material to a press.

In an automatic operation of a press, a roll feed which supplies material to the press dies at predetermined intervals is an indispensable mechanism. It comprises two rolls, one of which is a main feed roll connected to a rotating and driving mechanism, while the other serves to support the material pressed by the main feed roll and inserted between the two rolls as it is fed to the press dies. The roll feed device is usually mounted on the press, and the main feed roll is driven in a predetermined timed relationship to the reciprocating motions of the slide of the press. In supplying the material to the press dies, the main feed roll rotates intermittently and in one rotational direction so that the material is supplied in one direction only. Feeding of the material by such a roll feed device is widely employed because the device is an automatic device having great versatility and the use of which is not limited by the width or the thickness of the material.

An angle indexing cam, which is a mechanism for transforming the continuous motion associated with a crank shaft which drives the press slide into an intermittent motion for driving the main feed roll, has a smooth motion from the stopped condition to the rotating condition and back to the stopped condition, and the shape of this cam provides a high dependability of the precision of the feeding operation by the roll feed. Since the angle through which the angle indexing cam rotates during one pitch is fixed, the conventional methods for changing the lengths of the material fed by the roll feed device have been methods such as exchanging the feed rolls of the roll feed device or changing variable speed gears provided between an output shaft of the angle indexing cam and a shaft on the main feed roll.

However, these conventional techniques are disadvantageous in that many lengths of material to be fed cannot be accommodated and also it takes a long time for changing and adjusting the operation of the feed device.

Moreover, among the above-mentioned techniques, in the method of exchanging the feed rolls there are the drawbacks that the thickness of the material fed may be changed when the rolls are changed, and that it is necessary to adjust a releasing device for temporarily discontinuing the urging of the two rolls against each other.

In the method of changing the variable speed gears, it is usually the practice to provide an intermediate gear between the output shaft of the angle indexing cam and the shaft of the main feed roll, but in variable speed gears in which the positions of the shafts are fixed and the engaged gears are simultaneously exchanged, it is not possible to employ many kinds of variable speed gears because the combination of the gears is limited due to modules.

OBJECTS AND BRIEF SUMMARY OF THE INVENTION

It is an object of the present invention to overcome the above-described disadvantages of the conventional feed devices and to provide a roll feed device in which the output shaft of the angle indexing cam and the drive shaft of the main feed roll are connected by variable speed disks, so that it is possible to select the pitch of the feeding of the material freely.

Another object of the present invention is to provide a roll feed device in which changing of the pitch of feeding of the material can be performed simply by exchanging two variable speed disks provided between the output shaft of the angle indexing cam and the shaft of the main feed roll, so that only a short time is required for the changeover operation and press operating efficiency is improved.

Still another object of the present invention is to provide a roll feed device in which the output shaft of the angle indexing cam and the shaft of the main feed roll are directly connected by two variable speed disks with no intermediate gear as in a conventional variable speed gear mechanism, so that the size of the roll feed device can be reduced and the mounting thereof on the press can be facilitated since it does not require a large space.

DETAILED DESCRIPTION OF THE INVENTION

Figure 1:
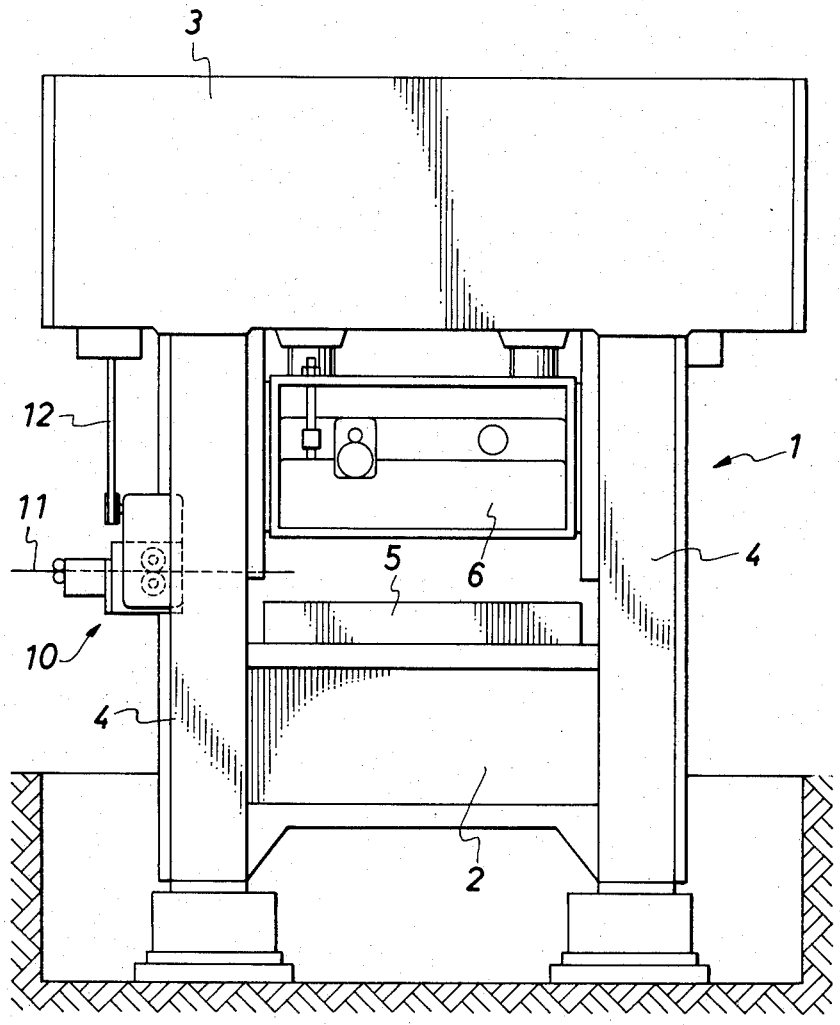
FIG. 1 is a front elevation view of a press with the roll feed of the present invention thereon.
Figure 2:
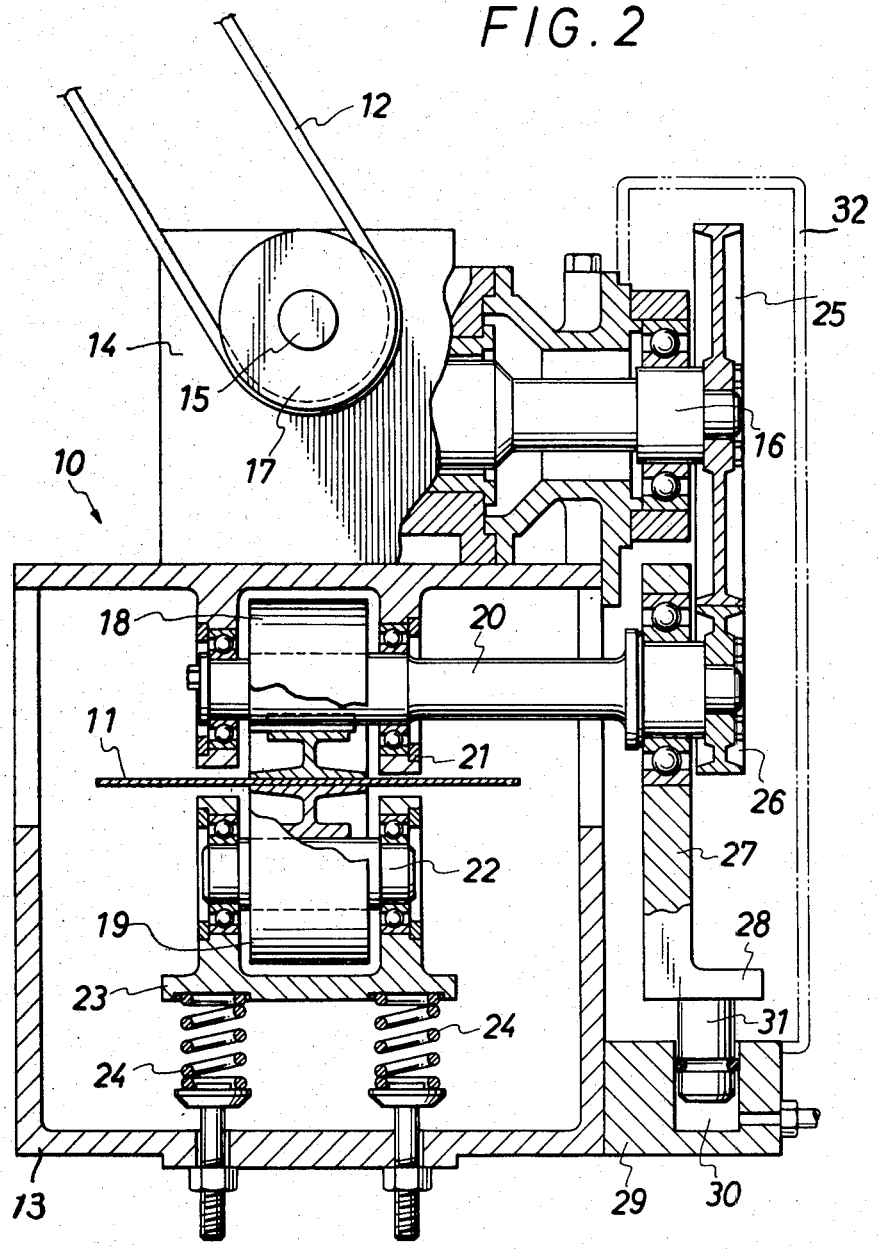
FIG. 2 is an end view, partly in section and on an enlarged scale, showing the details of the roll feed device according to the present invention.
Figure 3:
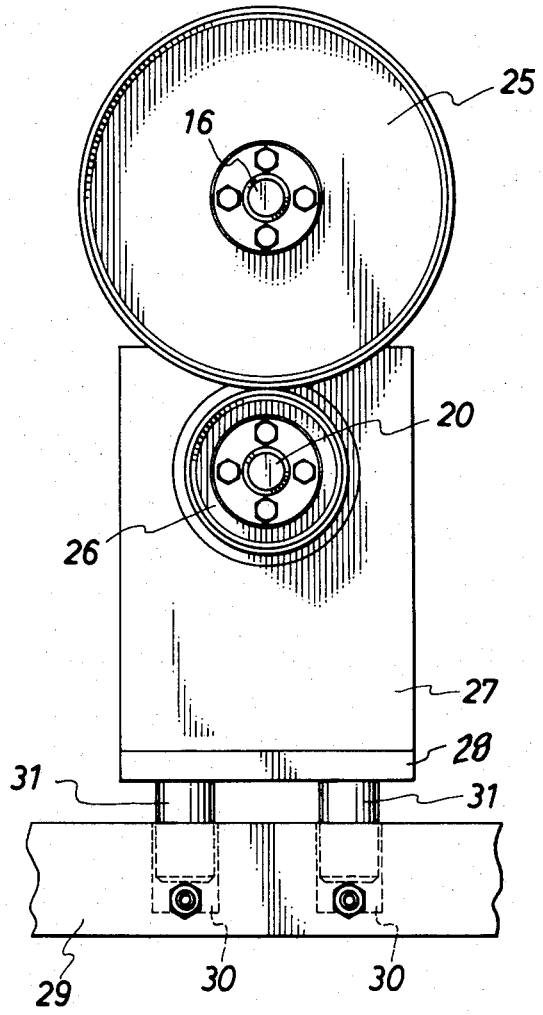
FIG. 3 is a side elevation view of the roll feed device showing the variable speed disk which connects the output shaft of the angle indexing cam and the shaft of the main feed roll.

The press 1 of FIG. 1 is a conventional general purpose press having a bed 2 and a crown 3 supported on posts 4, in which are housed tie rods (not shown). On the bed 2 is fixed a bolster 5, and a slide 6 is vertically slidably mounted for vertical movement between the bed 2 and the crown 3 and between the posts 4, being driven at predetermined intervals by a crank mechanism (not shown) provided in the crown. Dies (not shown) are mounted on the bolster 5 and the slide 6, and the material 11 to be pressed is fed between the dies from outside the posts 4.

The roll feed device 10 of the present invention is mounted substantially midway between the bolster 5 and the slide 6 on one of the posts 4, and it supplies material 11, such as sheet metal fed from an uncoiling device (not shown) which uncoils a coiled sheet material and which is positioned adjacent to the press in a form ready for press-processing, to the press dies at predetermined intervals. The roll feed device 10 is driven by a belt 12 which operates in connection with the crank shaft of the crank mechanism of the press.

The roll feed device 10 comprises a box-shaped main body 13 and a cam housing 14 which houses a conventional angle indexing cam mechanism (not shown). The cam housing 14 is also provided with an input shaft 15 and an output shaft 16, and the continuous rotating movement of the input shaft 15 is transmitted to the output shaft 16 as intermittent rotating movement by means of the angle indexing cam mechanism housed in the housing 14. On the input shaft 15 is mounted a pulley 17, and the belt 12 engages and drives this pulley. The belt 12 is preferably a so-called "timing belt" having teeth on the inner surface, and the pulley has pinion-like teeth engaged by the teeth on the belt so that the pulley is driven without the belt slipping relative thereto.

Inside the main body 13 are provided two feed rolls 18 and 19, and the material 11 is engaged by and fed between the rolls. The roll 18 is the driven feed roll, and the roll 19 is the idle feed roll. A drive shaft 20 is rotatably mounted in bearings 21, and extends axially of the driven feed roll 18 parallel to the output shaft 16 of the angle indexing cam, the end opposite the end on which the roll 18 is mounted extending to a point adjacent the end of the output shaft 16. The shaft 22 of the idle roll 19 is rotatably mounted in bearings 23, and pressure means such as springs 24 engage the bearings 23 and press feed roll 19 against the feed roll 18.

Because the springs 24 press the idle roll 19 against the driven roll 18, and the material 11 fed by the frictional engagement of the two rolls with the material, if the material is still held between the rolls during the press-processing operation, there will be no play in which the pilot punch operates and as a result the dies may be damaged. Therefore, at the time of press-processing, it is necessary to temporarily free the material from the rolls. For this purpose, a releasing mechanism (not shown) is provided which pushes the bearings 23 for the idle roll 19 down against the action of the springs 24. The releasing mechanism operates in association with the crank shaft of the press, and it operates only at the time of press-processing.

On the output shaft 16 extending out of the cam housing 14 for the angle indexing cam and on the drive shaft 20 of the driven feed roll 18 extending out of the main body 13 are respectively removably mounted speed change disks 25 and 26. The circumferential surface of the first disk 25 on the output shaft 16 and that of the second disk 26 on the drive shaft 20 are in direct contact. Pressure means for maintaining the two disks 25 and 26 in contact is also provided. One such means can be fluid pressure means. The bottom of a bearing 27 in which the end of shaft 20 is journalled has a bed frame 28, and two open-topped cylinders 30 are provided in a support member 29 attached to the side of the main body 13. Pistons 31 slidable in respective cylinders 30 are fixed to the bottom of the bed frame 28.

Air under pressure or oil under pressure from the press is directed into the cylinders 30, and the variable speed disk 26 is pressed against the disk 25 by pushing the bed frame 28 upwardly. A fluid pressure cylinder mechanism has been described as one means to press the disks against each other, but it is also possible to employ springs in place of the cylinders.

The intermittent rotation of the output shaft 16 of the angle indexing cam is transmitted to the drive shaft 20 through the variable speed disks 25 and 26, and by the rotation of the shaft 20 the driven feed roll 18 and the idle feed roll 19 are intermittently rotated, thereby intermittently feeding the material 11 inserted between the two rolls 18 and 19. The length of the material which is fed is determined by the angle through which the rolls 18 and 19 rotate, and when the angle of rotation of the rolls is to be changed, it is only necessary to exchange the variable speed disks 25 and 26 for others having appropriate diameters.

Hardly any slippage will occur between the variable speed disks 25 and 26 due to the pressure means pressing the disk against each other, and what slippage may occur will be negligible and can be disregarded.

Because it is desirable that oils etc. used in the press operation not come in contact with the variable speed disks 25 and 26, a casing 32 is provided to cover them. Further, if the casing 32 is formed by a transparent plastic material, it is possible to visually inspect the disks as well as the feeding pitch of the material even when the press is operating.

As hereinbefore described, with the roll feed device of the present invention, it is not only possible to select the feeding pitch of the material to be operated on by the press at will, but also changing of the feeding pitch can be carried out by simply replacing the variable speed disks with similar disks of different size, thus requiring only a short time for changing the feed pitch.

Further, although there has been no specific description of the variable speed disks used in the present invention, it is within the scope of the present invention to provide knurling or the like on the contacting surfaces of the disks to improve the frictional contact.

What is claimed is:

1. A roll feed device for feeding a material to a press in a predetermined timed relationship to the operation of the press, said device comprising a pair of feed rolls between which the material is fed, one being an idle roll and the other being a driven roll, a drive shaft on said driven roll, an intermittent rotating mechanism operably associated with the drive of the press and having an output shaft, friction disk means easily removably mounted on said shafts and having the peripheral edges in frictional engagement with each other for driving said drive shaft from said output shaft and pressure means for urging the peripheral edges of said disk means into contact with each other, whereby an infinite number of feeding pitches can be provided by replacing the disks with other size disks.

2. A roll feed device as claimed in claim 1 further comprising a bearing supporting said drive shaft, and said pressure means comprise piston-cylinder means operatively associated with said bearing for exerting fluid pressure on said bearing for urging it toward said output shaft.

* * * * *